US007380964B2

(12) United States Patent
Nevers

(10) Patent No.: US 7,380,964 B2
(45) Date of Patent: Jun. 3, 2008

(54) RECESSED LUMINAIRE HAVING A MOISTURE BARRIER

(75) Inventor: Craig S. Nevers, Warwick, RI (US)

(73) Assignee: Genlyte Thomas Group, LLC, Louisville, KY (US)

( * ) Notice: Subject to any disclaimer, the term of this patent is extended or adjusted under 35 U.S.C. 154(b) by 236 days.

(21) Appl. No.: 11/134,193

(22) Filed: May 20, 2005

(65) Prior Publication Data

US 2006/0262536 A1 Nov. 23, 2006

(51) Int. Cl.
*F21S 15/00* (2006.01)

(52) U.S. Cl. ..... 362/364; 362/147; 362/148; 362/362; 277/315; 277/607; 277/635

(58) Field of Classification Search ..... None
See application file for complete search history.

(56) References Cited

U.S. PATENT DOCUMENTS

| | | | | | |
|---|---|---|---|---|---|
| 536,792 | A | | 4/1895 | Soden | |
| 745,173 | A | | 11/1903 | Fielding | |
| 819,437 | A | | 5/1906 | Jones | |
| 1,761,528 | A | * | 6/1930 | Fyrberg | 362/294 |
| 1,863,470 | A | * | 6/1932 | Colabrese | 48/4 |
| 1,918,484 | A | * | 7/1933 | Naysmith | 362/305 |
| 1,958,304 | A | | 5/1934 | Hough | |
| 2,116,162 | A | | 5/1938 | Smally | |
| 2,119,452 | A | | 5/1938 | Woodhead | |
| 2,170,871 | A | * | 8/1939 | Niemann | 362/267 |
| 2,294,007 | A | * | 8/1942 | Trautner | 362/517 |
| 2,305,934 | A | | 12/1942 | Steber | |
| 2,511,937 | A | | 6/1950 | Natale | |
| 2,582,659 | A | | 1/1952 | Tamminga | |
| 2,805,327 | A | * | 9/1957 | Gerstel | 362/296 |
| 3,328,573 | A | * | 6/1967 | Nava et al. | 362/267 |
| 3,557,361 | A | | 1/1971 | McCarty | |
| 3,617,733 | A | | 11/1971 | Adams | |
| 4,128,865 | A | | 12/1978 | Johnson | |
| 4,450,511 | A | * | 5/1984 | Micha | 362/267 |
| 4,450,512 | A | | 5/1984 | Kristofek | |
| 4,485,430 | A | | 11/1984 | Achiaga Fustel | |
| 5,072,301 | A | * | 12/1991 | Dziedzic | 348/821 |
| 5,188,402 | A | * | 2/1993 | Colgate et al. | 285/332 |
| 5,234,639 | A | * | 8/1993 | Smith | 264/46.5 |
| 5,386,356 | A | | 1/1995 | Davis, Jr. et al. | |
| 5,440,471 | A | | 8/1995 | Zadeh | |
| 5,474,467 | A | | 12/1995 | Chen | |
| 5,573,419 | A | | 11/1996 | Chen | |
| 5,632,644 | A | | 5/1997 | Lin | |
| 5,643,006 | A | | 7/1997 | Wang et al. | |
| 5,662,413 | A | * | 9/1997 | Akiyama | 362/365 |
| 5,667,296 | A | | 9/1997 | Cheng et al. | |
| 5,673,997 | A | * | 10/1997 | Akiyama | 362/147 |
| 5,743,757 | A | | 4/1998 | Chen | |

(Continued)

*Primary Examiner*—Sandra O'Shea
*Assistant Examiner*—Danielle Dunn
(74) *Attorney, Agent, or Firm*—James E. Cole; Middleton Reutlinger

(57) ABSTRACT

A recessed luminaire having a moisture barrier is disclosed. The recessed luminiare has a socket cup which receives a removable and deformable moisture barrier gasket, the moisture barrier gasket forming a seal along an inner diameter of an aperture which receives a lamp. The recessed luminaire has a moisture barrier which isolates the electronic compartment area of the socket cup of a luminaire and prevents moisture access therein.

18 Claims, 8 Drawing Sheets

U.S. PATENT DOCUMENTS

| | | | |
|---|---|---|---|
| 5,743,758 | A | 4/1998 | Cheng et al. |
| 5,758,959 | A | 6/1998 | Sieczkowski |
| 5,759,062 | A | 6/1998 | Chen |
| 5,842,882 | A | 12/1998 | Sato et al. |
| 5,876,236 | A | 3/1999 | Chen |
| 6,095,847 | A | 8/2000 | Lin |
| 6,206,546 | B1 | 3/2001 | Krogman |
| 6,280,215 | B1 | 8/2001 | Rice |
| 6,322,380 | B1 | 11/2001 | Conroy |
| 6,796,688 | B2 | 9/2004 | Huang |
| 6,905,225 | B2 | 6/2005 | Pearl |
| 2005/0101187 | A1* | 5/2005 | Tansi et al. ..... 439/615 |

* cited by examiner

RECESSED LUMINAIRE HAVING A MOISTURE BARRIER

TECHNICAL FIELD

The present invention relates to a recessed luminaire which may be installed in a wet location and which has a removable moisture barrier gasket.

DETAILED DESCRIPTION OF THE PREFERRED EMBODIMENTS

Figure 1:
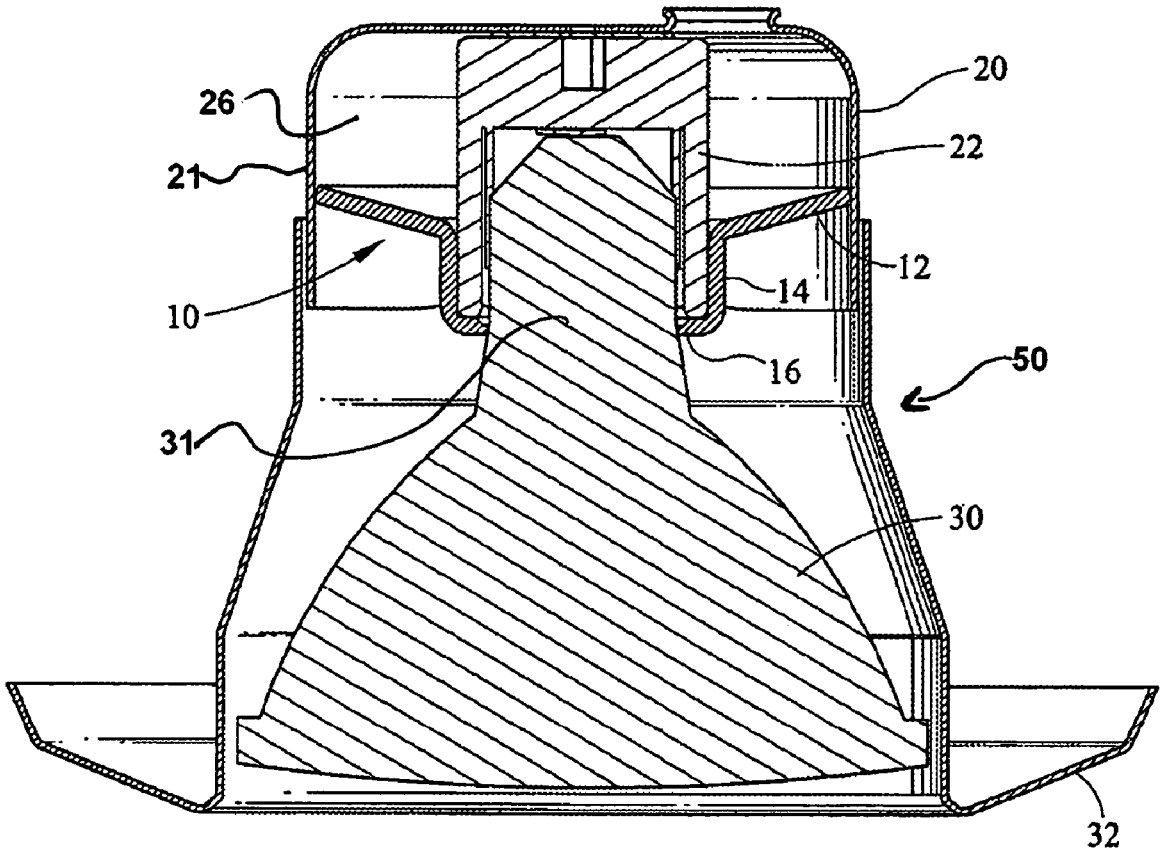
FIG. 1 is a side sectional view of the recessed luminaire having a moisture barrier of the present invention.

The recessed luminaire 50 of the present invention which has a removable moisture barrier gasket 10 included therewith is disclosed in FIG. 1. The recessed luminaire 50 with the moisture barrier gasket is utilized for fixture trim wet location placement in order for the luminaire to provide a barrier for moisture, preventing the moisture from reaching the electrical components of the fixture in order to be suitable for installation and use in wet locations. The recessed luminaire 50 of the present invention which has a pliable and removable moisture barrier gasket 10 may be used with a variety of trims and without lens, gaskets in the trim or a limited annulus fixture. The flexibility of the gasket 10 allows it to conform to irregular surfaces and to variations in size of lamp assuring a seal that may comply with industry standards for wet location installation. The recessed light fixture may be utilized in potentially moisture laden areas such as in a bathroom or shower.

As depicted in the figures, the recessed luminaire 50 of the present invention incorporates a socket cup 20, the socket cup maintaining a lamp socket 22 for threadably receiving a lamp 30. As shown in the figure, a reflector trim 32 may be retained on the socket cup 20 as is typically installed and the placement of the moisture barrier gasket 10 within the socket cup 20 effectively seals or creates a moisture barrier around the neck of the lamp 30 thereby preventing moisture from entering into the electrical component area 26 of the socket cup 20.

The moisture barrier gasket 10 of the present invention, as is seen in FIG. 1, sealingly engages or surrounds a portion of the lamp, and in this embodiment the moisture barrier gasket 10 seals around a neck portion 31 of lamp 30. However, as may be readily seen, the moisture barrier gasket 10 disclosed herein may effectively seal a lamp at any location.

Figure 2:
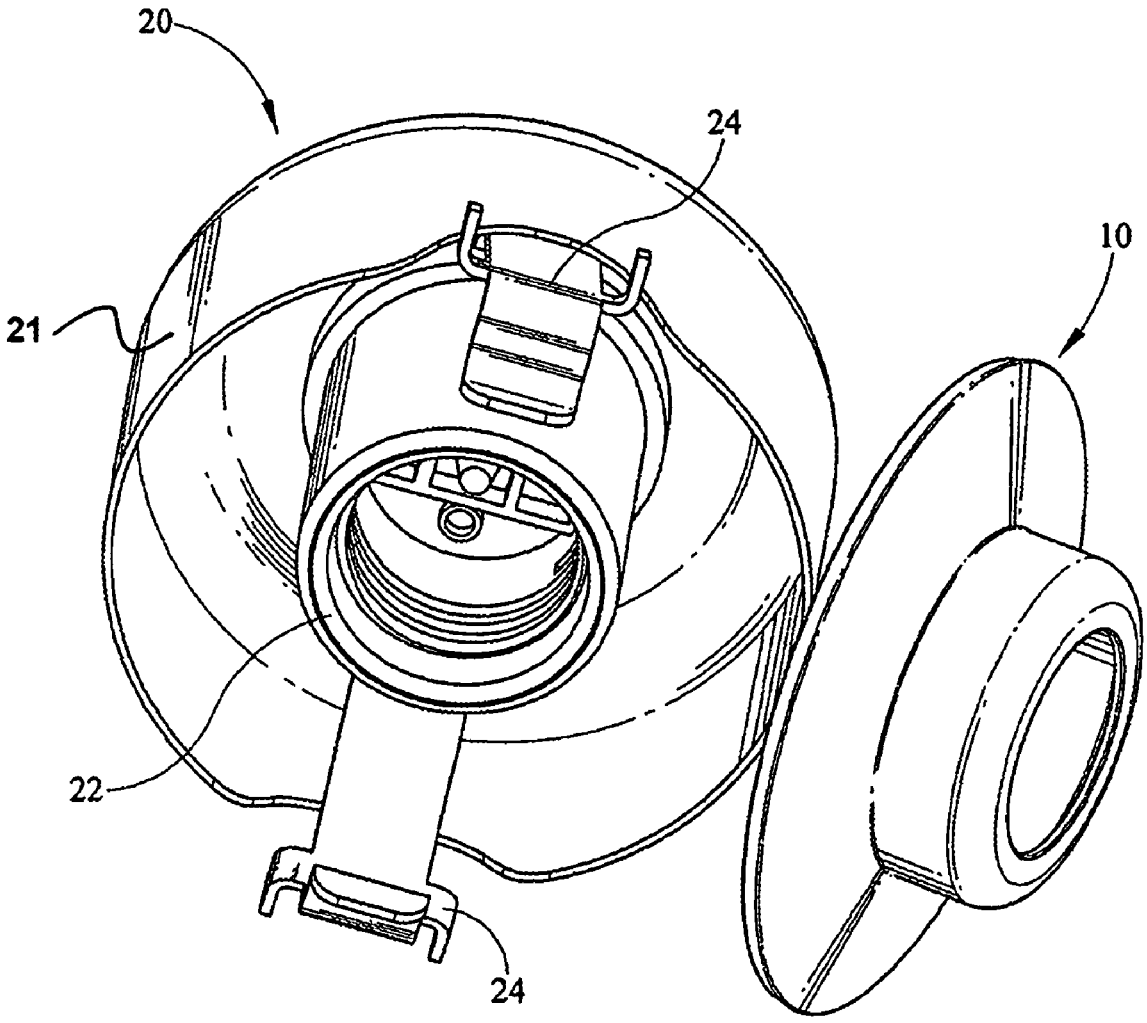
FIG. 2 is a lower perspective view of the socket cup and moisture barrier gasket utilized in the present invention.

The moisture barrier gasket 10 of the present invention is removable from the socket cup 20 as can be seen in FIG. 2 and may be installed therein in order to create a moisture barrier recessed luminaire. As is seen in FIG. 2 and in FIG. 3, the socket cup 20 has an annular socket cup side wall 21 which depends downwardly from a top wall. The socket cup side wall 21 forms the boundaries of the electrical component area 26 of the socket cup and encloses the electronic component area 26 and the lamp socket 22. The lamp socket 22, located within the socket cup 20 forms the electrical connectivity to the lamp 30 and typically threadably receives the lamp 30 therein but may receive the lamp in any fashion such as to provide electrical connectivity between the lamp 30 and the electrical lead in wires to the luminaire 50.

Figure 3:
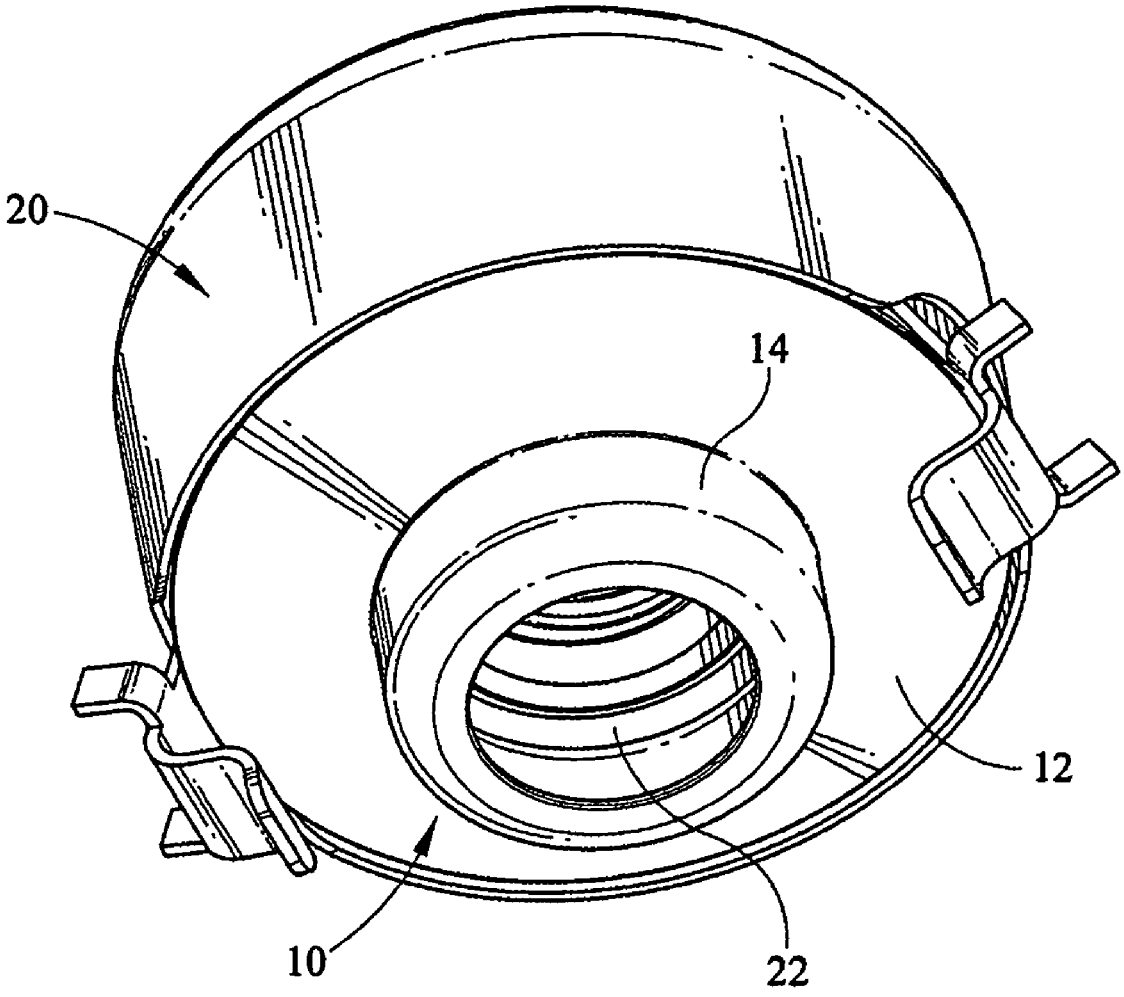
FIG. 3 is a lower perspective view of the moisture barrier gasket of the present invention installed in the socket cup.

As shown in FIG. 2 and in FIG. 3, the socket cup 20 has reflector spring clips 24 which are utilized to retain the reflector trim 32 shown in FIG. 1. The area bounded by socket cup side wall 21 may form an inner diameter which receives the moisture barrier gasket 10 as is shown in FIG. 2. The moisture barrier gasket 10 depicted in FIG. 2 is inserted within the socket cup 20 such that the neck 14, shown in FIG. 4A, extends downwardly from the base flange 12 of the gasket 10 such that the lamp flange 16 is positioned just below the lower edge or lip of the lamp socket 22 as is shown in FIG. 1.

As shown in FIGS. 2 and 3, the moisture barrier gasket 10 is inserted into the area defined by the socket cup side wall 21, the moisture barrier gasket 10 having a diameter formed by the base flange 12. The diameter of the base flange 12 may be slightly greater than the inner diameter of the annular opening formed by socket cup side wall 21 such that the moisture barrier gasket 10, when inserted into the socket cup 20 fits snuggly therein. The moisture barrier gasket 10, once inserted into the socket cup 20, as is depicted in FIG. 3, is held in place by stretching of the annular neck 14 of the gasket 10 over the lamp socket 22 in order to create a tight seal and a tension or friction fit therebetween. This interface between the neck 14 of the moisture barrier gasket 10 and the lamp socket 22 is shown in FIG. 1 and allows the gasket to functionally engage and depend from the socket 22 while also providing a seal.

As is also evident, the lamp flange 16, forms an annular opening which resides below the opening of the lamp socket 22 for receiving the neck 31 of lamp 30. Thus, this embodiment depicts the lamp flange 16 as interfacing directly against the neck 31 of the lamp 30. However, many alternative constructs may be available for introducing moisture barrier removable gasket within the socket cup and lamp socket in order to provide a removable or non-removable moisture barrier. Such modifications are felt to fall within the teachings of the present inventive disclosure and are incorporated within the teachings hereof.

As is again shown in FIG. 1, FIG. 2 and FIG. 3, the outer flange or edge of the base flange 12 from gasket 10 may be larger than the inside diameter of the mating socket cup 20 so that the gasket 10 conforms to the shape of the cup and springs that it seals. As is evident from FIG. 3, the aperture defined by the lamp flange 16, formed on the gasket 10, receives the lamp therein such that the lamp may readily be threaded into the lamp socket 22 of the socket cup 20.

Figure 4A:
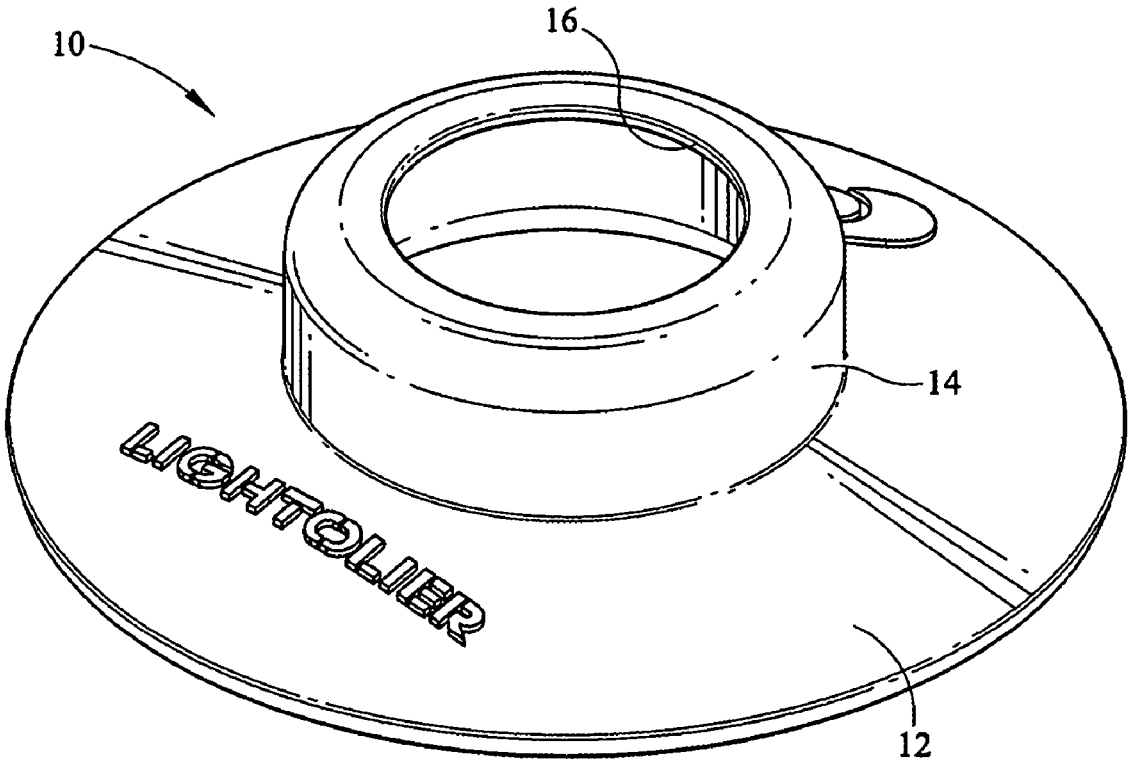
FIG. 4A is an upper perspective view of the moisture barrier gasket of the present invention.
Figure 4B:
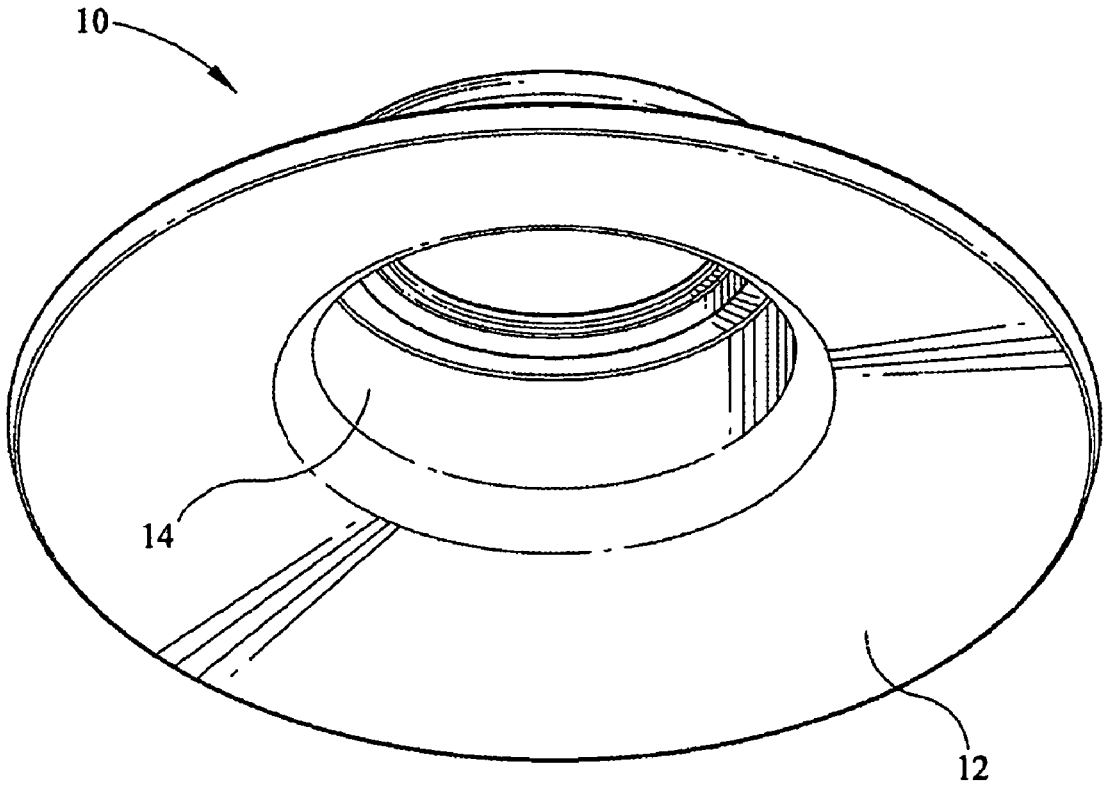
FIG. 4B is a lower perspective view of the moisture barrier gasket of the present invention.
Figure 5:
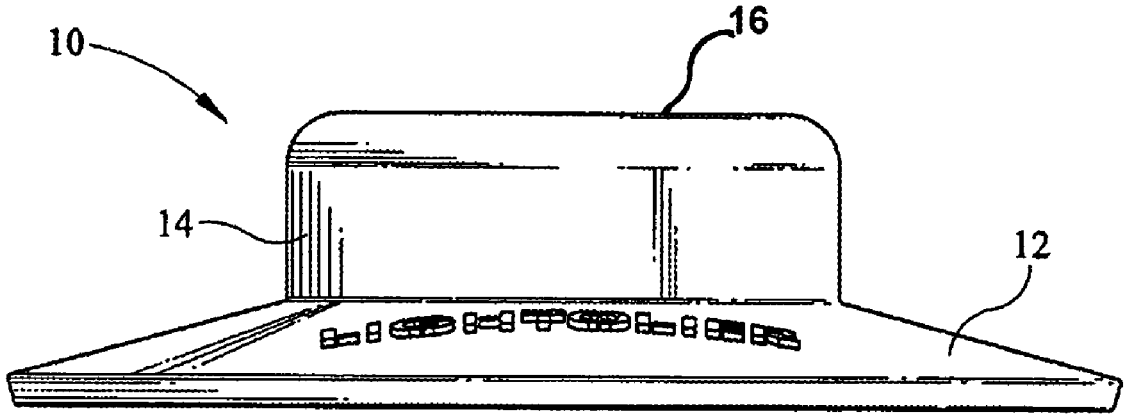
FIG. 5 is a side view of the moisture barrier gasket of the present invention.

As shown in FIGS. 4A and 4B, the moisture barrier gasket 10 has an outwardly extending tapered cone shaped flange or base flange 12 which extends from an outer periphery inwardly to the substantially vertical neck 14. The moisture barrier gasket 10 additionally has a lamp flange 16 which extends inwardly from the top edge of the neck 14, as is depicted in the side sectional of FIG. 6. Interposed between the substantially vertical side wall 14 and the top edge or lip of the lamp flange 16 may be a beveled, angular or curved cross-sectional transition area between the neck 14 and lamp flange 16. As is also seen from the side view of FIG. 5 of the moisture barrier gasket 10 of the present invention, the base 12 forms a tapered cone shape extending upward from its outer perimeter to the substantially vertical side wall 14. The base flange 12, as previously mentioned, forms an outer diameter which may be slightly larger than the inner diameter formed of socket cup side wall 21 so that a snug fit may be assured. This is not required however, as the gasket 10 may be held in position with cup 20 by virtue of the fictional engagement between neck 14 and the outer surface of the lamp socket 22.

During normal installation, the tapered cone shaped flange or base flange area 12 of the gasket 10 inverts itself slightly making the gasket 10 difficult to remove from the socket cup 20 in sealing the outer edge even more firmly. Thus, even if the outer most edge of the flange 12 is pushed into the socket cup, as is shown in FIG. 1, there is sufficient radial force from the shape of the gasket 10 to ensure a good seal and tension or friction fit from the gasket neck 14 and lamp socket 22 in order to ensure that it stays in place to provide proper moisture barrier characteristics. In other words, as is depicted in FIG. 1, the base flange 12 of the gasket 10 ideally rests along a lower edge of the socket cup side wall 21 and is not necessarily required to be pushed into the interior electrical component area 26 as is depicted in order to provide adequate moisture barrier properties and characteristics.

Typical lamps that are utilized in the recess luminaire 50 of the present invention which has a moisture barrier gasket 10 installed therewith are PAR lamps which have a neck portion 31 such that it may be adequately sealed by the inner aperture opening of the gasket 10. However, a large number of lamps may be utilized apart from PAR lamps which incorporates the novel features of the present inventive design of a recessed luminaire having a pliable and removable moisture barrier gasket.

Figure 6:
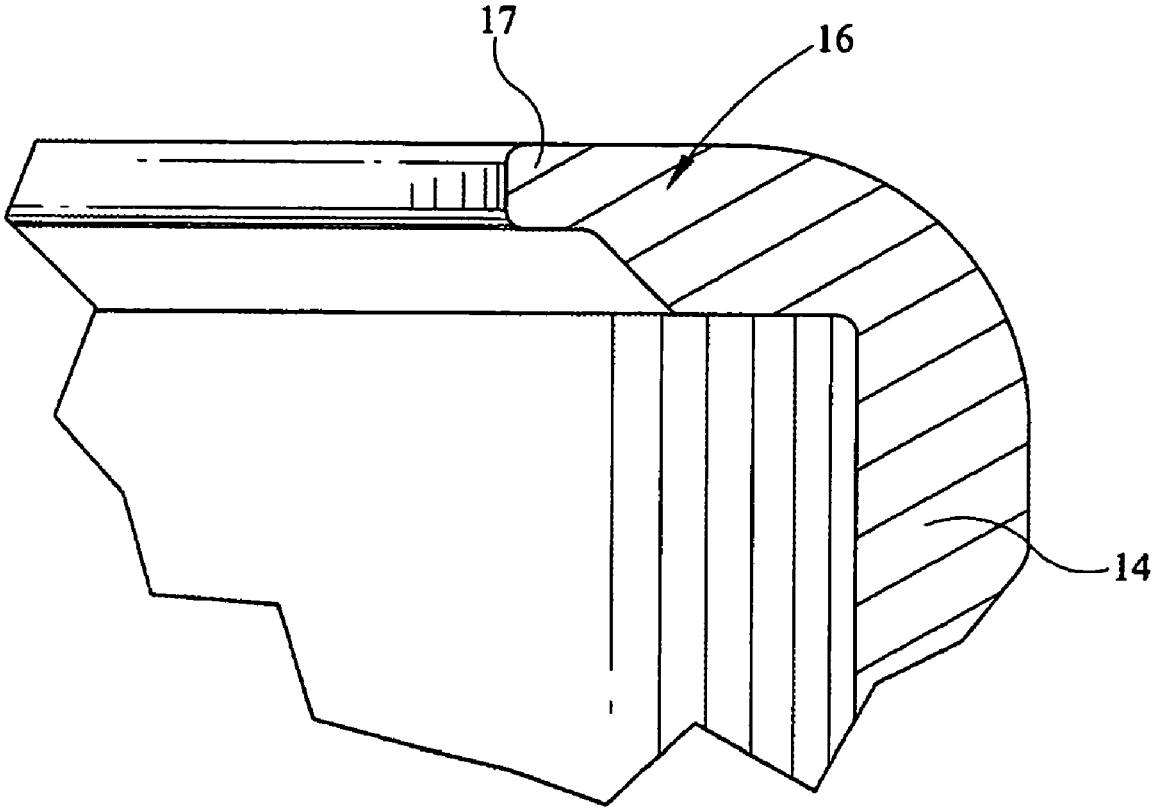
FIG. 6 is a close up side sectional view of the moisture barrier gasket of the present invention.
Figure 7:
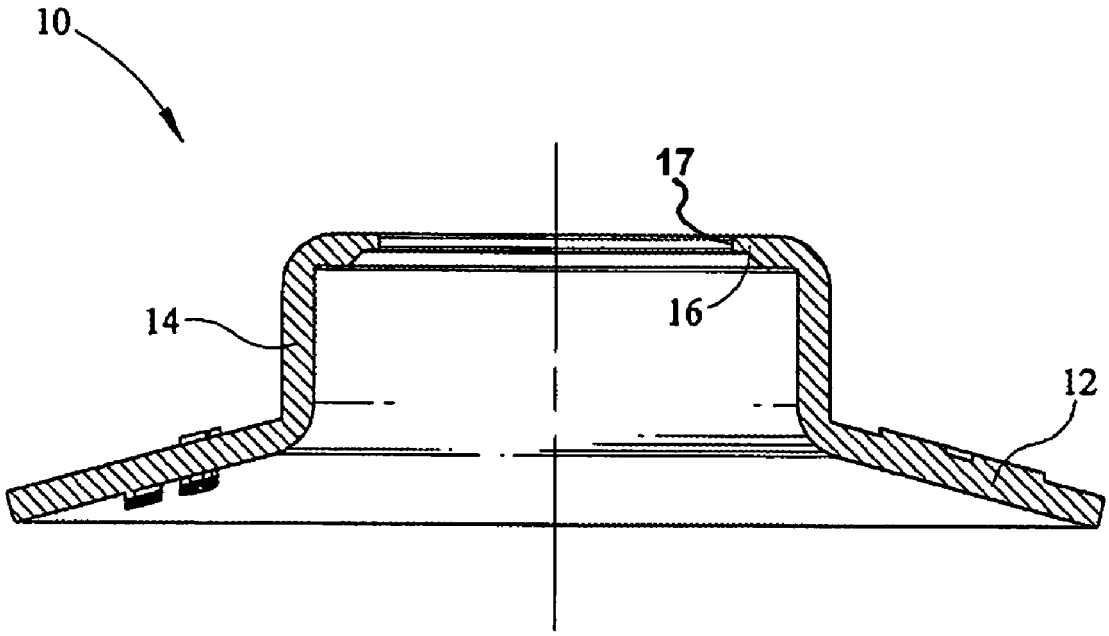
FIG. 7 is a side sectional view of the moisture barrier gasket of the present invention.

Turning to FIG. 6 and FIG. 7, the gasket 10 has an inner diameter flange or thinned section 17 forming the aperture which receives the neck portion of the lamp. The inner diameter of the gasket 10 formed along the thinned section 17 has a thickness which may be thinner than the rest of the material of the gasket 10 and particularly the lamp flange and neck 16 and 14 respectively. Thus, providing a thinned section 17 of the inner diameter of the lamp flange 16 makes the lamp flange 16 much more flexible in order to conform to the various shapes and details of the neck 31 of the lamp 30 so that it will conform to the shape of the lamp which it is designed to seal. The thinned section 17 or finger of the gasket 10 extends inwardly from the edge of the lamp flange. When the gasket is installed, the lamp is inserted through the aperture formed by the thinned section 17 of the gasket and into the socket 22. The thin inner flange 17 distorts out of the way and seals the lamp as it is threaded into the socket.

The moisture barrier gasket 10 is made of a material that is high temperature silicone and is flexible and pliable but rigid enough to maintain and conform its shape. The recessed luminaire having a moisture barrier or moisture resistant properties has a removable pliable sealing gasket 10 which may be inserted for placement in the recessed luminaire 50 of the present invention when installed in potentially wet locations. The barrier 10 forms an adequate moisture seal between the exterior of the lamp 30 and the internal electrical component area 26 of the socket cup 20. The removable gasket 10 is in sealing relationship around the lamp wherein the gasket is deformable substantially around the diameter of the lamp neck or lamp. The moisture barrier gasket 10, as previously indicated, is removable from the luminaire 50 and in particular from the socket cup 20 and provides adequate sealing engagement between an inner diameter of an aperture formed to receive the neck of the lamp and the lamp itself.

I claim:

1. A recessed luminaire having a moisture barrier, comprising:

a socket cup having a top wall and a depending side wall forming an electrical compartment area;

a lamp socket fixed within said socket cup, said lamp socket having an edge defining an opening;

a reflector trim element mechanically affixed to said socket cup;

a deformable and removable moisture barrier gasket received within said socket cup around said lamp socket and forming an inner aperture;

said moisture barrier gasket being a one-piece gasket engaging an inner surface of said socket cup and extending inwardly to said lamp socket, said gasket receiving said edge defining said opening of said lamp socket;

a lamp having a lamp neck, said lamp neck extending through said inner aperture and into said lamp socket;

wherein said moisture barrier gasket forms a moisture barrier between an opening in said reflector trim and said electrical compartment area of said socket cup.

2. The recessed luminaire of claim 1 wherein said gasket has a neck, said neck frictionally engaging said lamp socket.

3. The recessed luminaire of claim 2 wherein said gasket has a tapered cone base extending outward from said neck and in engagement with said side wall of said socket cup.

4. The recessed luminaire of claim 1 wherein said lamp socket has a lower annular end forming a lamp receiving area, said inner aperture of said gasket in adjacent relationship with said lower annular end of said lamp socket.

5. The recessed luminaire of claim 1 wherein said gasket has a substantially vertical side wall and an inwardly extending lamp flange, said inwardly extending lamp flange having a thinned section forming said inner aperture.

6. The recessed luminaire of claim 5 wherein said moisture barrier gasket is a silicone based material.

7. The recessed luminaire of claim 1 wherein said moisture barrier gasket is a deformable moisture resistant material.

8. The recessed luminaire of claim 1 wherein said gasket is deformable to substantially conform to the shape of an outer diameter of said lamp socket.

9. A moisture resistant recessed luminaire, comprising:

a socket cup having a lamp socket affixed therein and having a side wall;

said lamp socket having an edge defining an opening;

a reflector trim mechanically attached to said socket cup;

a deformable and removable moisture resistant gasket in frictional engagement with said lamp socket and extending outward from said lamp socket to an inner surface of said side wall of said socket cup, said moisture resistant gasket having an aperture formed therein;

said moisture resistant gasket positioned over said edge defining said opening of said lamp socket;

a lamp extending through said aperture of said moisture resistant gasket and into said lamp socket;

wherein said lamp is in sealing relationship with an inner edge forming said aperture of said moisture resistant gasket.

10. The moisture resistant gasket of claim 9 wherein said inner edge forming said aperture of said gasket is formed of a thinned section.

11. The moisture resistant recessed luminaire of claim 9 wherein said removable moisture barrier gasket has a annular base flange and an upwardly extending neck, said gasket further having a lamp flange extending inwardly from a top section of said upwardly extending neck.

12. The moisture resistant luminaire of claim 11 wherein an inner edge of said lamp flange is thinner than said lamp flange.

13. The moisture resistant recessed luminaire of claim 12 wherein said gasket is comprised of a moisture resistant material.

14. The moisture resistant recessed luminaire of claim 9 wherein said gasket has an annular base which forms a tapered cone.

15. A luminaire having a removable sealing gasket, comprising:

a socket cup having a top wall and a side wall depending from said top wall, a lamp socket positioned interior to said top wall and said side wall;

said lamp socket having an edge defining an opening for receiving a lamp;

a trim mechanically affixed to said side wall of said socket cup;

a removable one-piece sealing gasket having an annular base, a substantially vertical neck wall and an inwardly directed lamp flange, said neck wall in frictional engagement with said lamp socket, and said gasket receiving an edge defining an opening of said lamp socket; and a lamp in sealing engagement with said lamp flange of said removable gasket.

16. A luminaire having a removable sealing gasket of claim 15 wherein said removable gasket has a thinned annular finger extending inwardly from said lamp flange and in sealing engagement with a neck portion of said lamp.

17. The luminaire having a removable sealing gasket of claim 15 wherein said gasket is deformable to substantially deform to the diameter of said lamp and said socket cup.

18. A method of forming a moisture barrier in a recessed luminaire comprising:

deforming a pliable moisture barrier gasket around a lamp socket in a socket cup;

frictionally engaging a neck portion of said gasket against an edge defining a lamp opening in said lamp socket wherein said gasket extends outward to a side wall of said socket cup;

installing a lamp through an aperture in said gasket and into said lamp socket such that a seal is formed between said lamp and said gasket.

* * * * *